United States Patent [19]

Barns

[11] 4,307,738

[45] Dec. 29, 1981

[54] PRE-MANICURE NAIL BATH DEVICE

[75] Inventor: Ileana D. Barns, Riverside, Conn.

[73] Assignee: Clairol Incorporated, New York, N.Y.

[21] Appl. No.: 200,179

[22] Filed: Oct. 24, 1980

[51] Int. Cl.[3] ..... A45D 29/18

[52] U.S. Cl. ..... 132/74.5

[58] Field of Search ..... 132/74.5, 75.8, 73

[56] References Cited

U.S. PATENT DOCUMENTS

| | | | |
|---|---|---|---|
| 1,581,317 | 4/1926 | Kirkman | 424/61 |
| 2,041,158 | 5/1936 | Thuesen | 424/61 |
| 2,245,929 | 6/1941 | Mangold | 132/73 |
| 3,055,357 | 9/1962 | Redka | 128/32 |
| 3,292,642 | 12/1966 | Del Vecchio | 132/74.5 X |
| 3,917,816 | 11/1975 | Yueh | 424/61 |
| 3,965,495 | 6/1976 | McNair | 4/622 |
| 4,019,502 | 4/1977 | Elkins | 128/65 |
| 4,020,856 | 5/1977 | Masterson | 132/74.5 |
| 4,057,053 | 11/1977 | Kunz | 128/25 B |
| 4,075,457 | 2/1978 | Williams | 219/218 |

*Primary Examiner*—G. E. McNeill

*Attorney, Agent, or Firm*—George A. Mentis; Gerald S. Rosen

[57] ABSTRACT

There is disclosed a vibrating, heated nail bath for soaking fingernails prior to manicuring. The device is a bowl shaped plastic housing which is hollow. Inside the housing attached to the bottom of the bowl is a DC motor with a double ended shaft, the shaft supports a frame by eccentric cams. Connecting rods run from the frame to the bottom of soft elastic rubber membranes in the base of the bowl. The vibration is caused by the shaft rotating in the eccentric cams with the result that the frame vibrates and in turn vibrates the connecting rods which vibrate the membranes. A heater on the inside housing walls of the bowl keep the nail bath solution at 100° F. Known additives can be added to the nail bath.

8 Claims, 5 Drawing Figures

PRE-MANICURE NAIL BATH DEVICE

BACKGROUND OF THE INVENTION

This invention relates to a heated bath device for preparing fingernails for manicuring. More particularly, this invention relates to a device which heats a nail-treating bath solution and circulates it by vibration. The device has in its housing a resistance heater, a DC motor and a vibration means.

Generally, before one has fingernails manicured, the cuticles should be softened to enable them to be pushed back or removed. This is usually accomplished by soaking the fingers in hot soapy water. A quaternary ammonium salt lotion in the water will also soften the cuticles and provide a bactericidal effect. Sometimes, in order to have the added effect of softening the skin around the nails, vitamin A lotion is added. If one desires to combat brittleness of the fingernails, protein conditioners are used. The soaking procedure takes 15 to 20 minutes and during this time the water becomes cold. This results in an inefficient treatment and an uncomfortable feeling due to an oily film forming on the fingers.

In order to avoid the above problems, various devices have been developed. Masterson, U.S. Pat. 4,020,856 issued May 3, 1977, discloses a fingernail and hand cleaning apparatus having a liquid cleaning solution pumped through jets. This results in softened cuticles. No vibration or heating means are used.

Mangold, U.S. Pat. No. 2,245,929 issued June 17, 1941, discloses a manicure tray for soaking fingers and the nails. The tray has multiple compartments, for the hand to be placed in while the finger and nails are soaked, and for bottles of oil and cuticle remover, as well as other materials needed for the treatment. The Mangold device has soaking compartments for the nails but no vibration device or heater.

The following are representative of known vibrating heated footbaths:

Redka, U.S. Pat. No. 3,055,357 issued Sept. 25, 1962, discloses a vibrating heated device for soaking feet. It has a heater placed in the aqueous solution, two vibrator baths, and a removable pad with a papillary corrugated surface.

McNair, U.S. Pat. No. 3,965,495 issued June 29, 1976, discloses a foot tub having a massage means and a heater element placed in a compartment disposed centrally between spaces provided for insertion of the feet. The vibrator is an electrical vibrator motor between the internal console walls.

Elkins, U.S. Pat. No. 4,019,502 issued Apr. 26, 1977, discloses a hydrotherapy device comprising a tub-shaped lower housing having an upper rim which receives a tub-shaped upper housing of resilient material wherein the upper periphery is nested on and supported by the upper rim of the lower housing. The vibratory motor is directly connected to and supported by the bottom of the upper housing.

Kunz, U.S. Pat. No. 4,057,053 issued Nov. 8, 1977 which discloses a footbath massager with a vibrating warm water bath. The vibrating mechanism is positioned above the plane of the decks upon which the feet rest. The vibrator is an eccentric weight vibrator.

SUMMARY OF THE INVENTION

There is provided by this invention a heated vibratory fingernail bath device comprising a hollow housing, the upper section of which is in the general shape of a bowl suitable for holding a nail bath solution. The housing is made of any suitable plastic material which is inert under the conditions of use. The housing is formed by molding, e.g. injection molding. The bottom of the bowl is preferably of a generally ellipsoidal shape, however, any shape is suitable provided the fingers can easily and comfortably fit into the bowl. The front edge of the top of the housing is wide to provide a place to rest the hand while the fingers are in the bath. The base of the bowl contains two soft rubber membranes, preferably generally circular, with ridges for receiving the fingers. The membranes are spaced apart in order to provide comfort and enable the user to more easily move the nails and cuticles over the ridges which in cross section appear corrugated. Inside the housing, attached to the bottom side of the base of the bowl is a low voltage DC motor with a double-ended shaft which transmits vibrations via a frame through connecting rods which are in operative contact with the soft rubber membranes, causing the membranes to vibrate. A foil wrapped cord resistance heater is wrapped around the sides of the bowl inside the housing. The cords are wrapped in aluminum or other heat-conducting metal foil to enhance even transfer of heat and avoid hot spots. The vibration causes the nail bath solution in the bowl to circulate and the heater maintains the temperature of the solution at about 100° F. The solution can be water, a soapy aqueous solution, an aqueous quaternary ammonium salt lotion or a vitamin A lotion. The additives increase the cleaning and softening effects of the heated nail bath. Other known additives can be used to achieve specific desired effects.

DETAILED DESCRIPTION OF THE INVENTION

Figure 1:
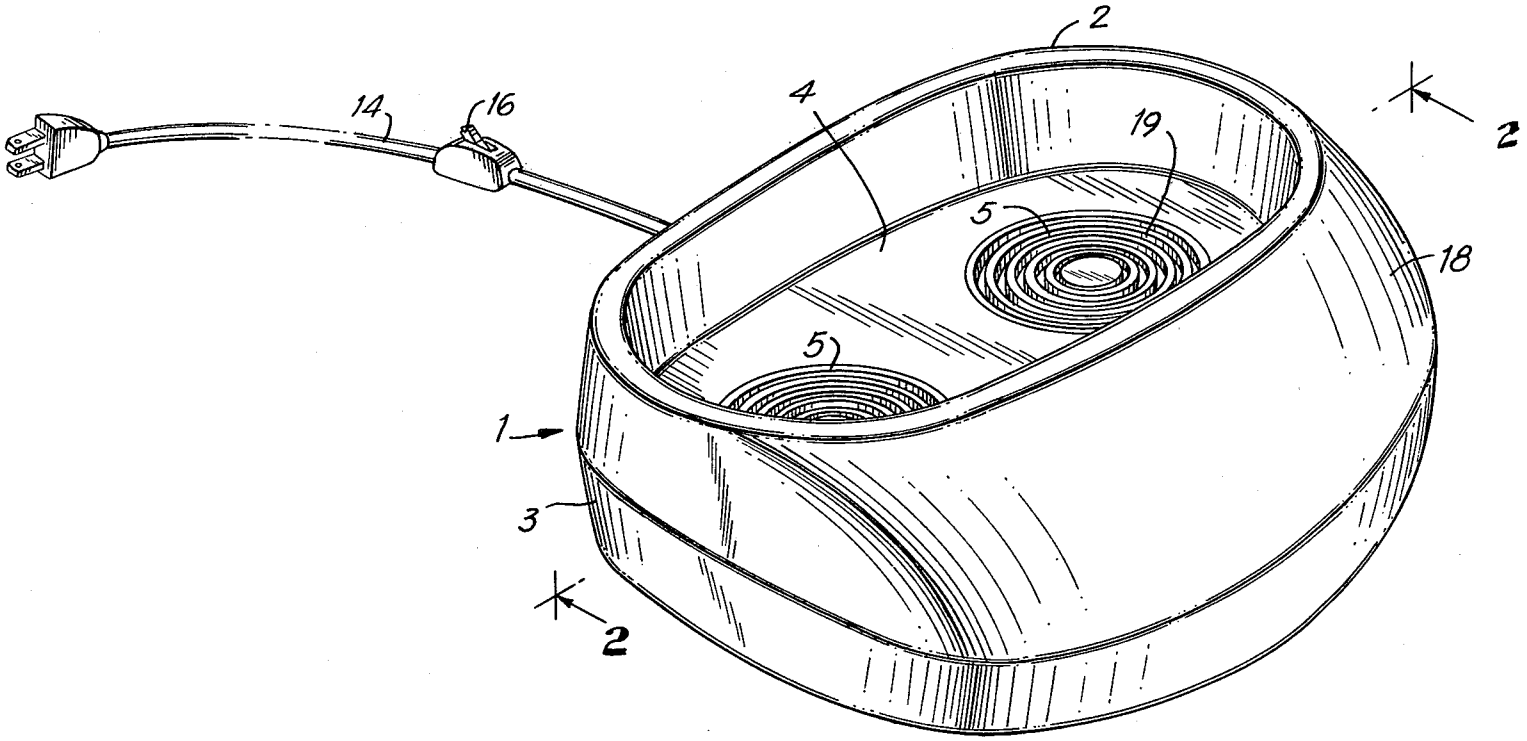
FIG. 1 is a perspective top view of the nail bath device.
Figure 2:
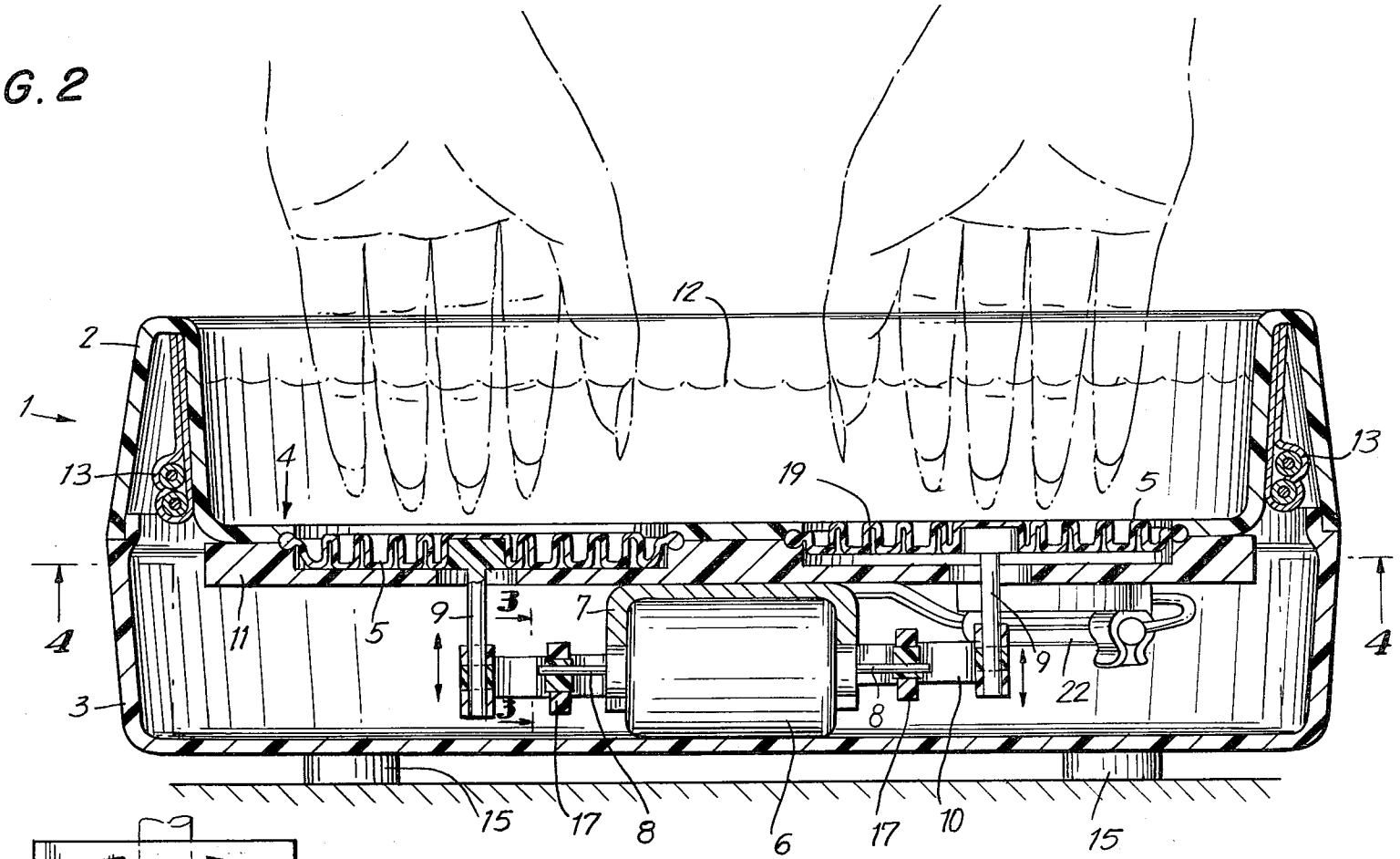
FIG. 2 is a side elevation view in section of the nail bath showing the vibrating and heating mechanisms.

As shown in FIGS. 1–5, the nail bath device of this invention is comprised of a hollow housing 1 with a generally ellipsoidal shape wherein the upper portion of the housing 2 is in the shape of a bowl 4. The bowl 4 is of a size and configuration which can comfortably accommodate the fingers of two hands. The front portion 18 of the rim of the upper housing 2 is widened so that the hands of the user can rest thereon while the fingers are in the bowl 4. The base of the bowl 4 has cutouts to which are attached, preferably by adhesive, generally circular soft rubber membranes 5. The membranes 5 can have their outside circumference beaded so it fits between the upper housing 2 and a plastic plate 11. These membranes 5 are spaced apart so that one can comfortably rest the fingers on them. The membranes 5 have an uneven surface, preferably concentric circles 19 of raised and depressed surfaces, i.e. corrugated. The texture of the membranes 5 is such that they are comfortable to the touch.

On the bottom of the inside of the upper housing 2 a rigid plastic plate 11 is attached., preferably by adhesive. This plate 11 has two holes which are concentric with the center of the soft rubber membranes 5 and smaller in diameter than the membranes 5. The plastic plate 11 holds the membranes 5 in place against the upper housing 2 and seals them against fluid leakage.

Figure 3:
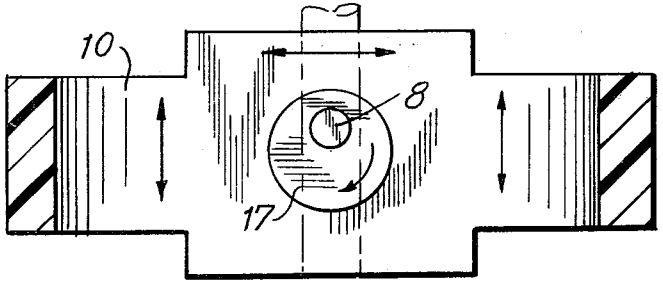
FIG. 3 is a sectional view of the vibrating mechanism taken along line 3—3 of FIG. 2.
Figure 4:
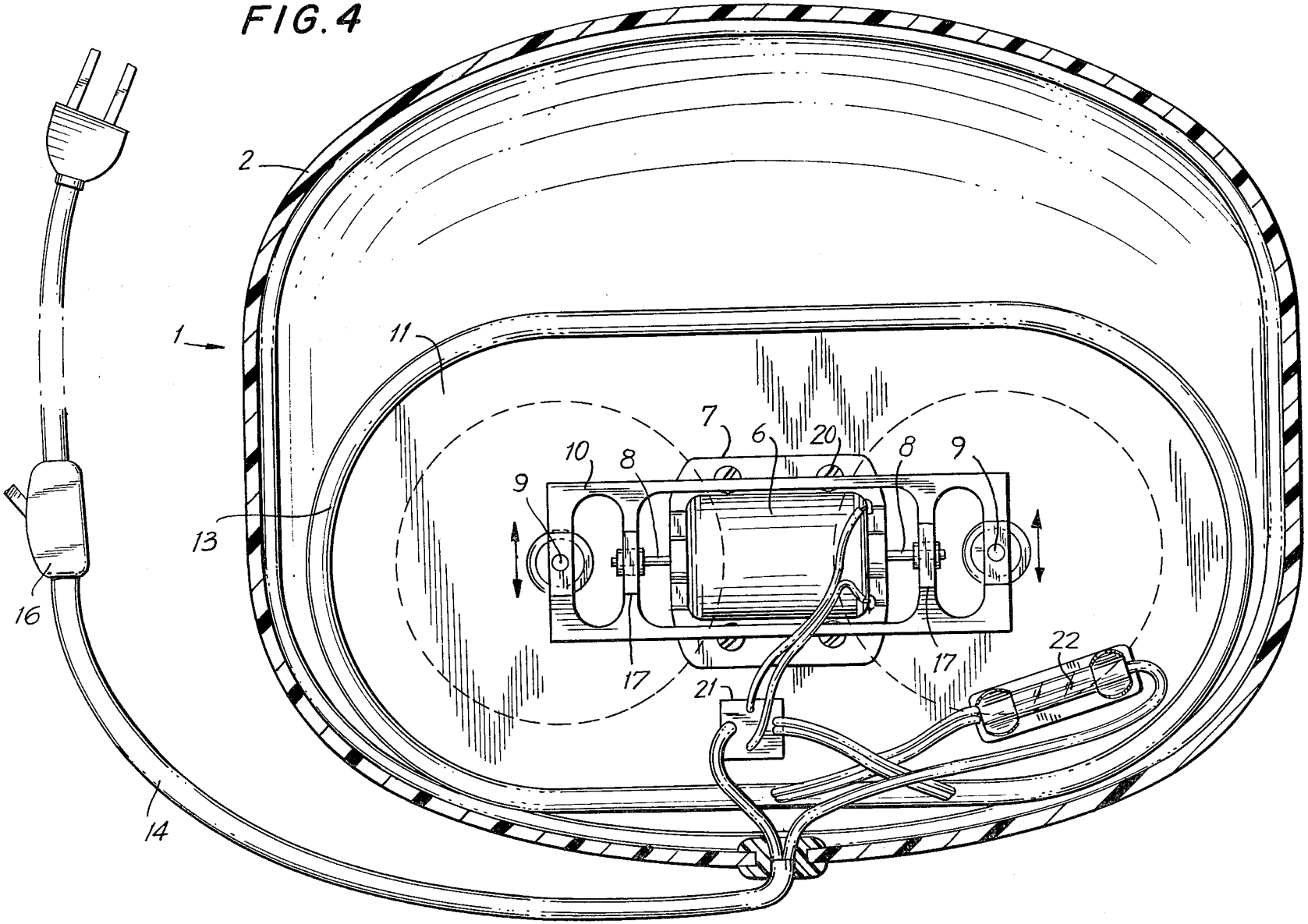
FIG. 4 is a bottom plan view, in section, of the device showing the vibrator, motor and heater taken along line 4—4 of FIG. 1.
Figure 5:
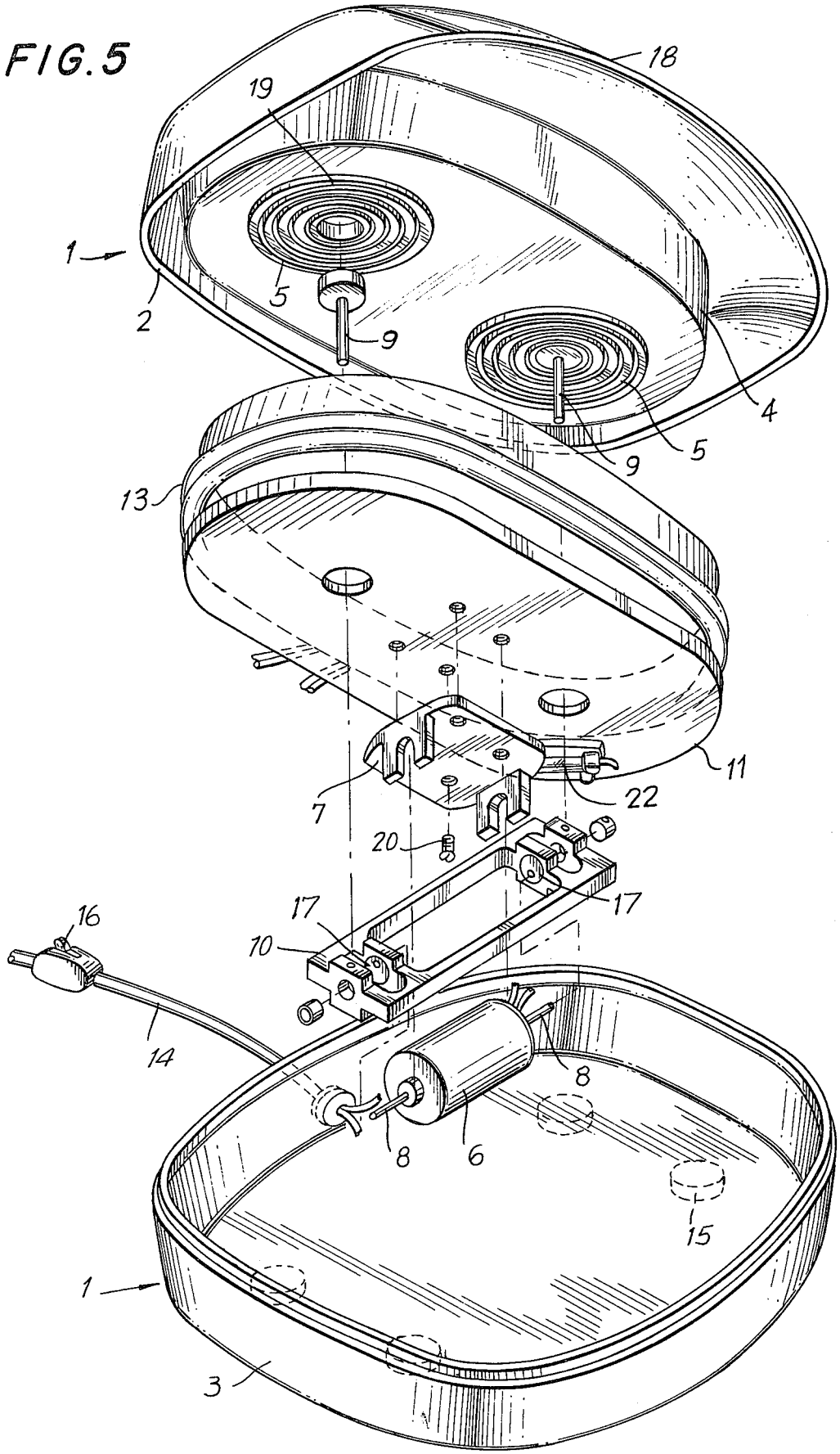
FIG. 5 is an exploded perspective view of the nail bath device.

A 4 volt, 5,000 to 6,000 rpm DC motor 6 with a double-end shaft 8 is rigidly attached to a bracket 7 by e.g. screws. The bracket 7 is rigidly attached, preferably by screws 20, to the bottom of the plastic plate 11. The bracket 7 and motor 6 are centered between the rubber membranes 5. Each end of the double-end shaft 8 is rotatably attached to a connecting rod frame 10 through eccentric cams 17 in the frame 10. The frame 10 is a generally rectangular rigid plastic frame that has on its ends, rigidly attached thereto, connecting rods 9. The connecting rods are generally perpendicular the frame 10 and contact the flexible rubber membranes 5 through the holes in the plastic plate 11 and the bottom of the bowl 4. When the motor 6 is turned on, the rods 9 rotate at about 5,000 to 6,000 rpm and cause the frame 10 to rapidly move up and down from end to end, as shown in FIG. 3, resulting in a vibration which is transmitted to the rubber membranes 5 by the connecting rods 9.

The motor 6 is connected to a bridge rectifier 21 which converts the AC current from the power source to DC. The electrical AC power source is connected to the rectifier 21 and thence the motor 6 by a cord 14. The cord 14 also has an on/off switch 16 intermediate its end and the rectifier 21. The cord 14 also supplies power to a foil wrapped cord resistance heater 13 of about 100 to 110 V which is wrapped around the walls of the bowl 4 inside the housing. A fuse 22 is in the line connecting the power source to the heater 13. The fuse is a safety feature to protect against short circuits and overheating. A thermostat can also be inserted in the circuit as a safety precaution. The heater 13 is composed of two rope heaters in parallel wrapped in aluminum or other suitable metal foil. The resistance is such that the heater 13 maintains the temperature of the solution 12 in the bowl 4 at about 100° F. The heater 13 is in series with the motor 6 through the bridge rectifier 21 so that when the power is turned on, both the heater 13 and the motor 6 operate.

The lower housing 3 is generally the same outer shape as the upper housing 2 and is attached to the upper housing 2 by any conventional means such as screws through bosses, snaps or clips. The lower housing 3 is hollow and of sufficient depth that the motor 6 will fit in without coming in contact with its base. The outside bottom of the lower housing 3 has sponge pads 15 attached by adhesive or screws upon which the whole device rests and which absorb some of the vibration, thus helping to eliminate undesirable noise.

The solutions 12 which are suitable for use in this invention can vary depending on the needs of the user. For example, if the cuticles are to be softened before manicuring, water and soap is sufficient, however, if desired, an oil with vitamin A in a quaternary ammonium salt lotion can be added to soften the skin and provide a bactericidal effect.

If the nails are brittle, then a protein composition can be added to the solution. Other known materials which soften or remove the cuticles, clean the nails, reduce nail brittleness, increase nail hardness or which soften the skin can be added to the nail bath solution.

The heated vibrating nail bath device of this invention operates in a preferred embodiment as follows.

About 300 ml. of aqueous nail bath solution at about 100° F. is placed into the bowl 4; this fills the bowl 4 to a little over half its capacity. The nail bath is turned on with the on/off switch 16 on power cord 14 activating the heater 13 and the motor 6. The motor 6 causes the double-end shaft 8 to rotate at about 5,000 to 6,000 rpm. Since the ends of shaft 8 are in eccentric cams 17 on the connecting rod frame 10, the rotation of the shaft 8 as shown in FIG. 3 causes the frame 10 to vibrate with the result that the connecting rods 9 which are rigidly attached to the frame cause the rubber membranes 5 and the bowl 4 to vibrate. The connecting rods 9 move about 0.024 inches at a rapid speed causing the vibration action. The vibration causes the aqueous nail bath solution 12 to circulate, with the result that its temperature is uniform throughout. The heater 13 has a resistance that produces sufficient heat to replace the heat lost to the atmosphere by the nail bath and maintain the temperature of the solution at about 100° F., the temperature at which cuticle treatment and softening is known to be most effective.

The user places the fingers in the solution 12 with the nails on the rubber membranes 5 and rubs the cuticles on the membranes 5. The palms of the hands rest on the front top edge 18 of the upper housing 2. The vibration and constant temperature are very pleasant and relaxing. The additives in the solution perform the desired functions. After about 10 to 20 minutes the treatment is completed and the nails are ready to be manicured.

I claim:

1. A vibrating, heated fingernail bath comprising a hollow housing in the shape of a bowl having:

two flexible rubber membranes having ridged surfaces spaced apart in the base of the bowl which is part of the upper surface of the housing;

a means for sealing the rubber membranes from leaking fluid, said means attached to the inner surface of the base of the bowl;

a motor with a double-end shaft attached to the inner surface of the base of the bowl between the rubber membranes;

a connecting rod frame having connecting rods which rest against the undersurface of the rubber membranes, said connecting rod frame supported on the ends of said double-end shaft by eccentric cams; and heating means in heat transfer relationship with the sides of said bowl, said heating means being wired in series to the said motor.

2. The vibrating, heated fingernail bath of claim 1 wherein the rubber membranes are circular and the ridged surfaces of the rubber membranes are concentric circular ridges.

3. The vibrating, heated fingernail bath of claim 1 wherein the sealing means for the rubber membranes is a rigid plastic plate covering the bottom of the base of the bowl on the inside of the housing.

4. The vibrating, heated fingernail bath of claim 1 wherein the motor is attached by means of a bracket and rotates the double-ended shaft at about 5,000 to 6,000 rpm.

5. The vibrating, heated fingernail bath of claim 1 wherein the connecting rods vibrate through about 0.024 inches.

6. The vibrating, heated fingernail bath of claim 1 wherein the heater is a rope heater wrapped in a metal foil.

7. The vibrating, heated fingernail bath of claim 1 wherein the heater maintains the temperature of a nail bath solution in said bowl at about 100° F.

8. The vibrating, heated fingernail bath of claim 1 wherein vibration absorbing pads are on the outside bottom surface of said housing.

* * * * *